US006762406B2

(12) United States Patent
Cooks et al.

(10) Patent No.: US 6,762,406 B2
(45) Date of Patent: Jul. 13, 2004

(54) ION TRAP ARRAY MASS SPECTROMETER

(75) Inventors: Robert G. Cooks, West Lafayette, IN (US); Ethan R. Badman, West Lafayette, IN (US); Zheng Ouyang, West Lafayette, IN (US); James M. Wells, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 17 days.

(21) Appl. No.: 09/578,673

(22) Filed: May 25, 2000

(65) Prior Publication Data

US 2003/0089846 A1 May 15, 2003

(51) Int. Cl.[7] ..... H01J 49/42

(52) U.S. Cl. ..... 250/292; 250/291

(58) Field of Search ..... 250/282, 288, 250/292

(56) References Cited

U.S. PATENT DOCUMENTS

| | | | | | |
|---|---|---|---|---|---|
| 4,982,088 | A | * | 1/1991 | Weitekamp et al. | 250/281 |
| 5,206,506 | A | | 4/1993 | Kirchner | 250/281 |
| 5,248,883 | A | | 9/1993 | Brewer et al. | |
| 5,399,857 | A | * | 3/1995 | Doroshenko et al. | 250/282 |
| 5,625,186 | A | * | 4/1997 | Frankevich et al. | 250/282 |
| 5,644,131 | A | * | 7/1997 | Hansen | 250/290 |
| 5,693,941 | A | * | 12/1997 | Barlow et al. | 250/292 |
| 5,793,091 | A | * | 8/1998 | Devoe | 257/432 |
| 6,005,245 | A | * | 12/1999 | Sakairi et al. | 250/281 |
| 6,121,607 | A | * | 9/2000 | Whitehouse et al. | 250/282 |
| 6,124,592 | A | * | 9/2000 | Spangler | 250/282 |
| 6,157,031 | A | * | 12/2000 | Prestage | 250/292 |
| 6,403,952 | B2 | * | 6/2002 | Whitehouse et al. | 250/288 |
| 6,483,109 | B1 | * | 11/2002 | Reinhold et al. | 250/290 |
| 2001/0002696 | A1 | * | 6/2001 | Kato | 250/281 |

OTHER PUBLICATIONS

Syms et al., "Fabrication of a microengineered quadrupole electrostatic lens," *Electronics Letters*, vol. 32, No. 22, Oct. 24, 1996, pp. 2094–2095.

Taylor et al., "Initial results for a quadrupole mass spectrometer with a silicon micromachined mass filter," *Electronics Letters*, vol. 34, No. 6, Mar. 19, 1998, pp. 546–547.

Syms et al., "Design of a Microengineered Electrostatic Quadrupole Lens," *IEEE Transactions On Electron Devices*, vol. 45, No. 11, Nov. 1998, pp. 2304–2311.

Holkeboer et al., "Miniature quadrupole residual gas analyzer for process monitoring and milliTorr pressures," *J. Vac. Sci. Technol.*, A 16(3), May/Jun. 1998, pp. 1157–1162.

Taylor et al., "Performance improvements for a miniature quadrupole with a micromachined mass filter," *Vacuum*, 53, 1999, pp. 203–206.

Freidhoff et al., "Chemical sensing using nonoptical microelectromechanical systems," *J. Vac. Sci. Technol.*, A, 17(4), Jul./Aug. 1999, pp. 2300–2307.

Ferran et al., "High–pressure effects in miniature arrays of quadrupole analyzers for residual gas analysis from $10^{-9}$ to $10^{-2}$ Torr," *J. Vac. Sci. Technol.*, A 14(3), May/Jun. 1996, pp. 1258–1265.

Orient et al., "Miniature, high–resolution, quadrupole mass–spectrometer array, "*Rev. Sci. Instrum.*, 68(3), Mar. 1997, pp. 1393–1397.

(List continued on next page.)

*Primary Examiner*—John R. Lee
*Assistant Examiner*—Johnnie L Smith, II
(74) *Attorney, Agent, or Firm*—Dorsey & Whitney LLP

(57) ABSTRACT

A mass spectrometer having an array of parallel and/or tandem ion traps. The ion traps are preferably formed by providing a body of conductive material with a plurality of holes forming ring electrodes and electrodes on opposite faces of said body, opposite the ends of said ring electrodes, to define with the ring electrodes a plurality of parallel ion traps.

49 Claims, 8 Drawing Sheets

OTHER PUBLICATIONS

Kaiser, Jr. et al., "Operation Of A Quadrupole Ion Trap Mass Spectrometer To Achieve High Mass/Charge Ratios," *Int'l. J. of Mass Spectrometry and Ion Processes*, 106 (1991), pp. 79–115.

Stafford, Jr. et al., "Recent Improvements In And Analytical Applications Of Advanced Ion Trap Technology," *Int'l. J. of Mass Spectrometry and Ion Processes*, 60 (1984), pp. 85–98.

Stafford, Jr. et al., "Recent Improvements In And Analytical Applications Of Advanced Ion Trap Technology," *Int'l. J. of Mass Spectrometry and Ion Processes*, 60 (1984), pp. 85–98.

Badman et al., "A Miniature Cylindrical Quadrupole Ion Trap: Simulation and Experiment," *Analytical Chemistry*, vol. 70, No. 23, Dec. 1, 1998, pp. 4896–4901.

Kornienko et al., "Micro Ion Trap Mass Spectrometry," *Rapid Communications In Mass Spectrometry*, 13, 1999, pp. 50–53.

Julian, Jr. et al., "Broad–Band Excitation in the Quadrupole Ion Trap Mass Spectrometer Using Shaped Pulses Created with the Inverse Fourier Transform," *Anal. Chem*, 65, 1993, pp. 1827–1833.

Soni, "Selective Injection and Isolation of Ions in Quadrupole Ion Trap Mass Spectrometry Using Notched Waveforms Created Using the Inverse Fourier Transform," *Anal. Chem,* vol. 66, No. 15, Aug. 1, 1994, pp. 2488–2495.

Kenny et al., "Simultaneous Isolation of Two Different m/z Ions in an Ion–trap Mass Spectrometer and their Tandem Mass Spectra Using Filtered–noise Fields," *Rapid Communications In Mass Spectrometry*, vol. 7, 1993, pp. 1086–1089.

Wells et al., High–Resolution Selected Ion Monitoring in a Quadrupole Ion Trap Mass Spectrometer, *Anal. Chem*, vol. 67, No. 20, Oct. 15, 1995, pp. 3650–3655.

* cited by examiner

ION TRAP ARRAY MASS SPECTROMETER

GOVERNMENT SUPPORT

This invention was made with Government support under Contract No. 530-1440 ONR Grant No. N00014-97-0251 awarded by the United States Office of Naval Research. The Government has certain rights to this invention.

BRIEF DESCRIPTION OF THE INVENTION

This invention relates generally to ion trap mass spectrometers, and more particularly to mass spectrometers employing an array of miniature ion traps of the same or different sizes, or a combination thereof.

BACKGROUND OF THE INVENTION

An area of increasing interest in mass spectrometry is that of miniature instrumentation. Recent progress has been made toward the total miniaturization (sample introduction, ion source, mass analyzer, ion detection, data acquisition, and vacuum systems) of all the common types of mass spectrometers. The mass analyzers which are currently the main focus of miniaturization efforts are the linear quadrupole and time-of-flight (TOF) mass analyzers. A number of groups have developed single miniature linear quadrupole analyzers (Syms, R. R. A.; Tate, T. J.; Ahmad, M. M.; Taylor, S. *Electron. Lett.* 1996, 32, 2094–2095) (Taylor, S.; Tunstall, J. J.; Syms, R. R. A.; Tate, T.; Ahmad, M. M. *Electron. Lett.* 1998, 34, 546–547) (Syms, R. R. A.; Tate, T. J.; Ahmad, M. M.; Taylor, S. *IEEE Trans. Electron Devices,* 1998, 45, 2304–2311) (Holkeboer, D. H.; Karandy, T. L.; Currier, F. C.; Frees, L. C.; Ellefson, R. E., *J Vac. Sci. Technol. A,* 1998, 16, 1157–1162) (Taylor, S.; Tunstall, J. J.; Leck, J. H., Tindall, R. F.; Jullien, J. P.; Batey, J; Syms, R. R. A.; Tate, T; Ahmad, M. M., *Vacuum* 1999, 53, 203–206) (Freidhoff, C. B.; Young, R. M.; Sriram, S.; Braggins, T. T.; O'Keefe, T. W.; Adam, J. D.; Nathanson, H. C.; Syms, R. R. A.; Tate, T. J.; Ahmad, M. M.; Taylor, S.; Tunstall, J., *J. Vac. Sci. Technol. A* 1999, 17, 2300–2307).

Arrays of mass analyzers have been used previously, starting with the commercial double-beam Kratos MS30 sector instrument of a generation ago, and, more recently, including multiple linear quadrupoles each of identical size (Ferran, R. J.; Boumsellek, S., *J. Vac. Sci. Technol. A* 1996, 14, 1258–1265) (Orient, O. J.; Chutjian, A.; Garkanian, V., *Rev. Sci. Instrum.* 1997, 68, 1393–1397). In the latter cases, multiple analyzers are specifically used in order to provide higher ion currents while maintaining the favorable operating conditions of physically smaller devices, including higher pressure tolerance and lower working voltages. As an example of this approach, Kirchner (Kirchner, N. J.: U.S. Pat. No. 5,206,506, 1993) proposed a parallel electrostatic ion processing device composed of a parallel series of channels. Each channel was designed to store, process, and then detect ions. Due to the parallel architecture, high ion throughput and high capacity were expected.

Miniature mass spectrometers that can be operated in non-laboratory and harsh environments are of interest for continuous on-line and other monitoring tasks. Simplicity of operation and small size are the premier qualities sought in these devices. Only modest performance in terms of resolution and dynamic range is needed to address many of the problems to which these small instruments might be applied. Miniaturization of the mass analyzer must be accompanied by miniaturization of the entire system, including the vacuum system and control electronics. The ion trap mass analyzer is physically small. Nearly a decade ago a miniature version (2.5 mm internal radius) was described by Kaiser et al. (Kaiser, R. E.; Cooks, R. G.; Stafford, G. C.; Syka, J. E. P.; Hemberger, P. H., *Int. J. Mass Spectrom. Ion Processes* 1991, 106, 79–115).

One major issue with miniaturized mass spectrometers is the pressure tolerance of the device. Currently, pumping systems are size, power and weight prohibitive, and the miniature devices available do not provide the pumping speeds or base pressures associated with full-size pumps. Offsetting this is the fact that the pressure tolerance of small analyzers is greater than that of larger analyzers, since the shorter path lengths decrease the probability of ion/neutral atom or molecule collisions. Even though ion traps have relatively long path lengths, collisions with gases of lower mass and higher ionization potential have beneficial effects on resolution since they cool ions to near the center of the device (Stafford G. C.; Kelley, P. E.; Syka, J. E. P.; Reynolds, W. E.; Todd, J. F., *Int. J. Mass Spectrom. Ion Processes* 1984, 60, 85–98). The result is that quadrupole ion traps are the most pressure-tolerant of all the major types of mass analyzers, and small ion traps should be even more so. A pressure tolerant analyzer like the quadrupole ion trap, therefore, is of special interest as a miniature mass spectrometer, since base pressure can be higher and pumping capacity lower, allowing use of a simpler pumping system.

In the search for a robust mass analyzer for miniaturization, the quadrupole ion trap is a prime candidate due to its overall performance characteristics and operating conditions that are beneficial for the miniaturization process. Operation of the trap using simplified-applied voltages simplifies the control electronics needed to operate the ion trap as a mass analyzer. Also, given that a reduction in size causes a reduction in ion trapping capacity, a method to gain back total ion trapping capacity is needed when miniaturized ion traps are used, and the use of multiple individual traps is suggested for this purpose.

The conventional method of operating a hyperbolic quadrupole ion trap as a mass spectrometer is to perform a mass-selective instability scan. In this experiment the amplitude of the applied rf voltage is scanned so as to force ions of increasing m/z ratios into unstable trajectories, causing them to leave the trap and allowing them to impinge on an external detector such as an electron multiplier (Stafford G. C.; Kelley, P. E.; Syka, J. E. P.; Reynolds, W. E.; Todd, J. F., *Int. J. Mass Spectrom. Ion Processes* 1984, 60, 85–98). The relationship between the parameters involved is given by the Mathieu equations. The solution for ion motion in the z (axial) direction can be expressed in terms of the Mathieu parameter $q_z$ where:

$$q_z = \frac{8zV}{m\Omega^2(r_0^2 + 2z_0^2)}.$$

In this equation, V is the amplitude of the trapping rf voltage, m is the mass of the ion of interest, $r_0$ and $z_0$ are the inscribed dimensions of the ion trap, and $\Omega$ is the angular frequency of the rf voltage. It has been previously noted that, in principle, at a fixed value of $q_z$, variation in V, $\Omega$ or r will correspond to selection of ions of different m/z values (Kaiser, R. E.; Cooks, R. G.; Stafford, G. C.; Syka, J. E. P.; Hemberger, P. H. *Int. J. Mass Spectrom. Ion Processes* 1991, 106, 79–115) (Kaiser, R. E.; Cooks, R. G.; Moss, J.; Hemberger, P. H. *Rapid Comm. Mass Spectrom.* 1989, 3, 50–53). Indeed, scans of V have been used to record mass spectra, the value of $q_z$ being fixed by the boundary for ion stability or some other operating point in the stability diagram (Stafford, G. C.; Kelley, P. E.; Syka, J. E. P.; Reynolds, W. E.; Todd, J. F. J. *Int. J. Mass Spectrom. Ion Processes* 1984, 60, 85–98).

A cylindrical ion trap (CIT) was first described by Langmuir for use as an ion containment device, but not as a mass spectrometer. Subsequently, the use of CITs has focused mainly on ion storage, although recent experiments by Badman (Badman, E. R.; Johnson, R. C.; Plass, W. R.; Cooks, R. G. *Anal. Chem.* 1998, 70, 4896–4901) and Kornienko (Kornienko, O.; Reilly, P. T. A.; Whitten, W. B.; Ramsey, J. M. *Rapid Commun. Mass Spectrom.* 1999, 13, 50–53) (Kornienko, O.; Reilly, P. T. A.; Whitten, W. B.; Ramsey, J. M. *Rev. Sci. Instrum.* 1999, 70, 3907–3909) have shown them to perform well as mass spectrometers. CITs are also simpler to machine than standard hyperbolic quadrupole ion traps, especially on the millimeter scale. A cylindrical ion trap (CIT) consists of a barrel-shaped central ring electrode with two flat endcap electrodes, and as such, it is extremely simple to machine compared to the hyperboloid shapes of the electrodes in the standard quadrupole ion trap.

OBJECTS AND SUMMARY OF THE INVENTION

It is an object of the present invention to provide a mass spectrometer consisting of an array of quadrupole ion traps each element of which is operated using the same rf and dc trapping signals.

It is another object of the present invention to provide a mass spectrometer having simple miniaturized control electronics and pumping systems.

There is provided a mass spectrometer in which, in the first embodiment, each element of an array is an ion trap whose dimensions are proportionately varied. This allows the size ($r_0$ and $z_0$) of the device to be used as a variable in the Mathieu stability equation to trap ions of different mass/charge ratios in the individual ion traps with the same rf and dc trapping voltages. Each trap operates in the mass selective stability mode to trap ions of a given m/z value or range of m/z values. Isolation of ions in a quadrupole ion trap is commonly achieved by applying, along with the trapping rf voltage, a dc voltage between the ring electrode and the endcap electrodes or, alternatively, by the use of a waveform applied to one or more electrodes to resonantly eject ions of one or multiple mass/charge ratios through use of a pulse with frequency components equal to the frequencies of motion of the ions to be ejected. In this invention, the mass range selected for isolation is controlled via the applied voltages to be for a single m/z value (as is typically done) to a wide range of masses, including the entire mass range.

In the second embodiment, the array consists of identical-sized ion traps, also operated under common conditions. This type of array can be operated in a similar manner as the first embodiment, using same methods of ion isolation, ejection and detection. In this case, the invention allows increased ion trapping capacity over a single-sized ion trap operated under identical conditions, which improves overall signal intensity. Alternatively, with appropriate methods of ionization and injection, it allows simultaneous analysis of multiple samples using the same array mass spectrometer and the same vacuum, electronics and data systems.

In a further embodiment, the arrays may be operated in series whereby the first array can be used to accumulate ions before they are injected into the second array.

BRIEF DESCRIPTION OF THE DRAWINGS

The foregoing and other objects of the invention will be more clearly understood from the following detailed description when read in conjunction with the accompanying drawings in which.

DETAILED DESCRIPTION OF THE PREFERRED EMBODIMENT

Figure 1:
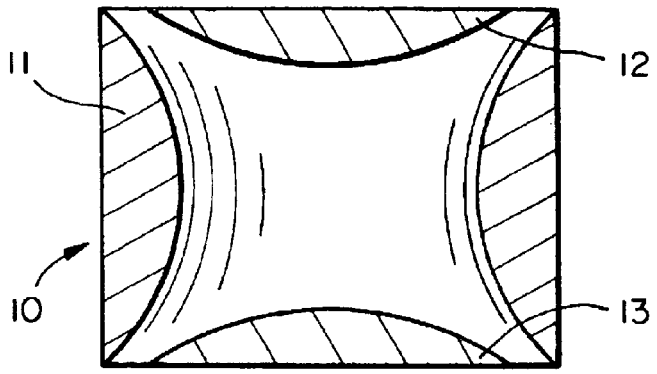
FIG. 1 is a cross-sectional view of a standard hyperbolic quadrupole ion trap (Paul trap) of prior art.
Figure 2A:
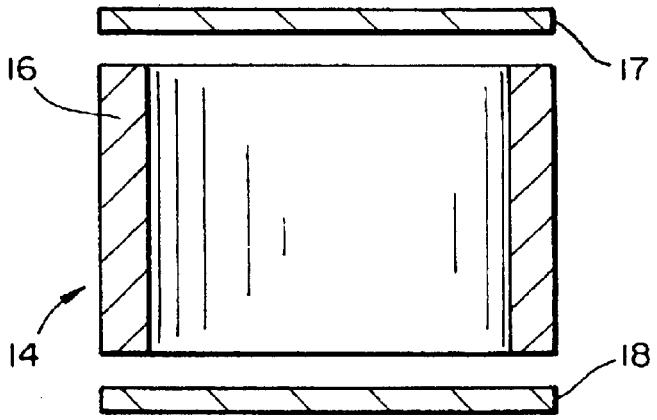
FIG. 2A is a cross-sectional view of a cylindrical quadrupole ion trap.
Figure 2B:
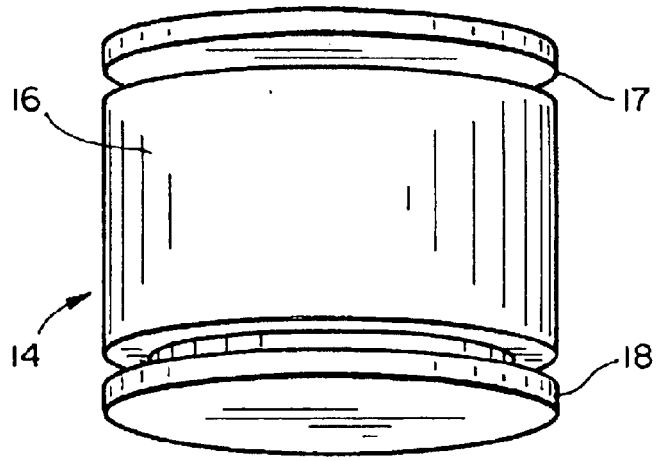
FIG. 2B is a three-dimensional representation of a cylindrical quadrupole ion trap.

A cross-sectional view of a standard (hyperbolic) ion trap 10 is shown in FIG. 1. Ions are trapped in the volume defined by the hyperboloid ring electrode 11 and hyperboloid endcap electrodes 12 and 13, by an rf voltage applied between the ring electrode and the end caps. FIGS. 2A and 2B show a cylindrical quadrupole ion trap 14 in which the hyperbolic electrode is replaced by a cylindrical ring electrode 16, and two flat endcap electrodes 17 and 18. Both the hyperbolic and the cylindrical ion trap mass analyzers of FIGS. 1 and 2 are operated under identical conditions and the electric fields present in both devices are substantially the same. In both cases, ions are formed in the trapping volume by means of an ionization electron beam, gated to allow or prevent electrons from entering the trapping volume, or through injection of externally generated ions into the trapping volume. Ions are trapped in a pseudo-potential well formed by the rf voltage applied between the ring electrode and the end caps, and they may be manipulated in various ways well known in the art, before mass analysis is performed.

Figure 3A:
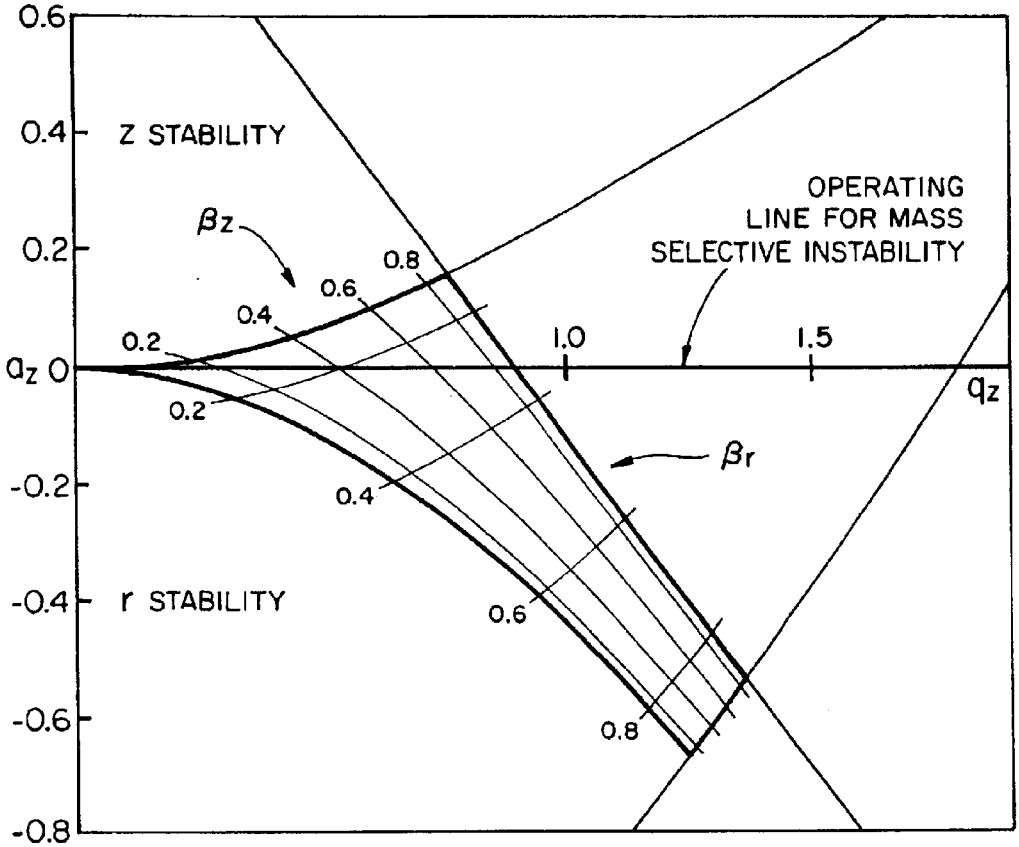
FIG. 3A is the Mathieu stability diagram for the quadrupole ion trap, showing the region of stability in the device as a function of the Mathieu parameters, $a_z$ and $q_z$.
Figure 3B:
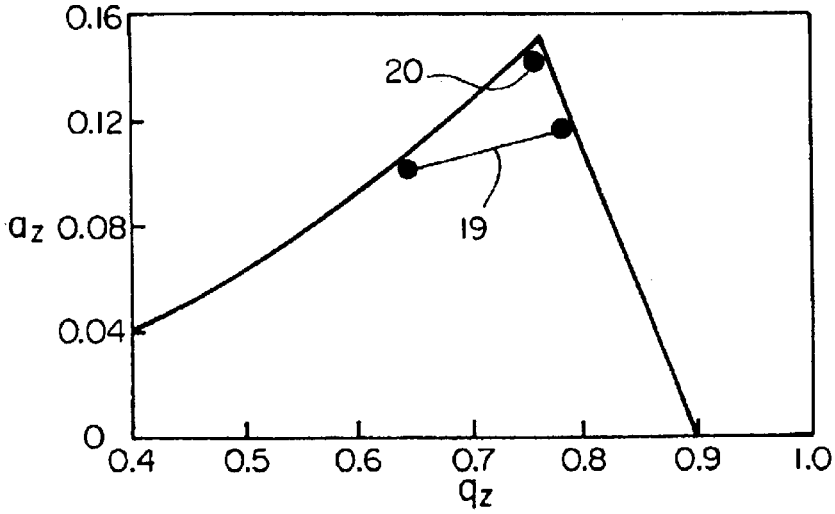
FIG. 3B is a portion of the Mathieu stability diagram showing two types of ion isolation methods that may be used in the present invention.

One type of manipulation is ion isolation, which, amongst other ways, can be performed by application of the appropriate dc voltage in addition to the trapping voltage to the ring electrode (a process known as rf/dc isolation). This can be understood by reference to the Mathieu stability diagram (FIG. 3A) which shows the regions of stability and instability, the transition between which is marked by the bold lines, as a function of the dimensionless Mathieu parameters, $q_z$ and $a_z$. These parameters are given by:

$$q_z = \frac{8zV}{m\Omega^2(r_0^2 + 2z_0^2)}$$

$$a_z = \frac{-16zU}{m\Omega^2(r_0^2 + 2z_0^2)}$$

in which V is the applied rf voltage, U is the applied dc voltage, z is the charge on the ions, m is the mass of the ion, the $r_0$ and $z_0$ are. the inner radius of the ring electrode and the center-to-endcap distance, respectively. When both the rf and dc voltages are applied while ions are trapped in the ion trap, ions of a range of mass/charge ratios can be made stable or unstable depending on their mass/charge ratios. FIG. 3B shows examples of two isolation experiments of particular importance to the invention: apex isolation 18, in which ions of a single mass-to-charge ratio are all that remain stable, and a lower resolution version of apex isolation 19, in which ions of a range of mass-to-charge ratios remain stable. The only difference between the two is the magnitude of the dc voltage applied to the ring electrode. Both of these types are used in the invention and will be described later. Other methods of ion isolation such as that performed using resonance ejection of unwanted ions, using stored-waveform inverse Fourier transform (SWIFT) ion isolation (Julian, R. K.; Cooks, R. G. *Anal. Chem.* 1993, 65, 1827) (Soni, M.; Cooks, R. G. *Anal. Chem.* 1994, 66, 2488–2496), filtered noise field (FNF) (Kenny, D. V.; Callahan, P. J.; Gordon, S. M.; Stiller, S. W. *Rapid Commun. Mass Spectrom.* 1993, 7, 1086) and selected ion storage (Wells, G.; Huston, C. *Anal. Chem.* 1995, 67, 3650) have been previously demonstrated in quadrupole ion traps and are within the scope of this invention.

For convenience and ease of manufacture, the individual ion traps in an array can be cylindrical ion traps (CITs) with flat endcap electrodes and a cylindrical ring electrode as shown in FIGS. 2A and 2B. In this case, an array of ring electrodes can be simply made by drilling holes of desired radii in a single piece of conductive material. In another, the holes can be formed in a semiconductor body by micromachining techniques. That is, by using a conductive semiconductor body, and by masking photolithographic exposure and chemical etching miniature holes of selected diameter. Alternatively, the array elements can consist of standard hyperbolic ion traps or traps of any other geometry or type, with all aspects of operation being the same as for devices consisting of cylindrical ion traps. The present invention will be described with focus on using ion traps with cylindrical ring electrodes, cylindrical ion traps (CIT), but it is not intended to limit the present invention to cylindrical ion traps.

Figure 4A:
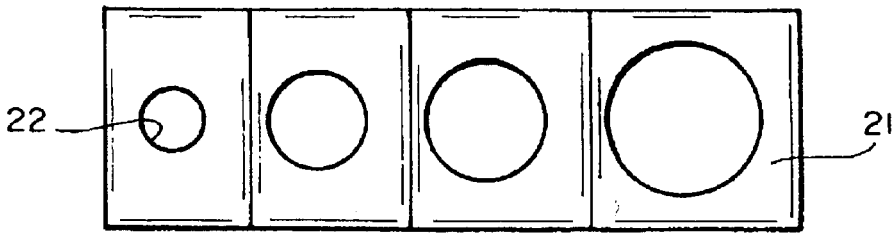
FIG. 4A is a top plan view of an ion trap having a cylindrical ring electrode array of different sizes.
Figure 4B:
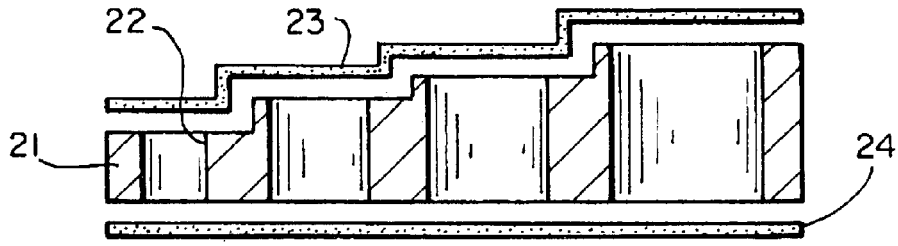
FIG. 4B is a cross-sectional view of the cylindrical ring electrode array of FIG. 4A.
Figure 5A:
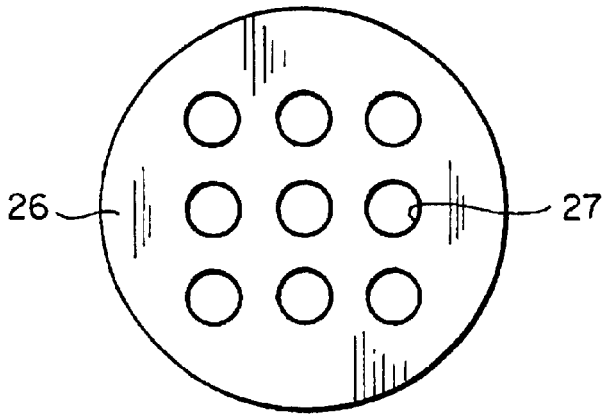
FIG. 5A is a top plan view of an ion trap having a cylindrical ring electrode array of the same sizes.
Figure 5B:
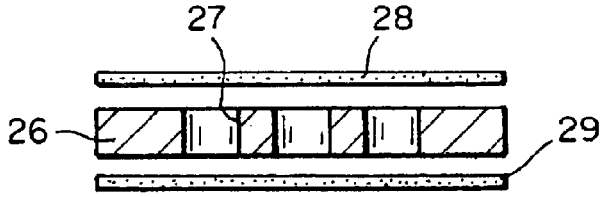
FIG. 5B is a cross-sectional view of the cylindrical ring electrode array of FIG. 5A.

FIGS. 4 and 5 show two embodiments of the invention. FIG. 4A is a top plan view of an array of CITs with cylindrical ring electrodes of varying radii formed in a body 21 of conductive material. FIG. 4B is a sectional view of the array of FIG. 4A showing the body 21 with cylindrical ring electrodes 22 and endcap electrodes 23 and 24. It is noted that the length of the cylindrical ring electrodes varies with the radius. FIG. 5A is a top plan view of an array of CITs with cylindrical ring electrodes of the same radii formed in body 26. FIG. 5B shows a sectional view of the array of FIG. 5A, showing body 26, cylindrical ring electrodes 27 and endcap electrodes 28 and 29. In both cases, the endcap electrodes are at distances from each other and from each array element selected to provide optimal operation of the CIT arrays. Such selection can easily be done by one skilled in the art.

The embodiment shown in FIG. 4 is appropriate for selection or trapping of ions of different mass/charge ratios (or ranges of ratios) in the individual array elements defined by the cylindrical ring electrodes 22 and endcaps 23 and 24. Rf/dc isolation, or another ion isolation method, is used and the dimensions of each array element (the appropriately proportioned $r_0$ and $z_0$) determine the range of masses trapped in each CIT of the array. It should be noted that the length and the radius of the traps must be varied together so as to maintain the appropriate combination of trapping electric field components (quadrupole as well as higher order field components). In fabricating CIT arrays it is convenient to drill the traps in a material of varying thickness, cut in either a concave or convex fashion. The exact choice of shape of this material will depend on the ion optical scheme used to bring ions to the traps from an external source.

In the embodiment of FIG. 5, the cylindrical ring electrodes 27 are all of the same radii and length. As a result, when a trapping rf/dc voltage is applied to the cylindrical ring electrodes, each CIT will capture ions of the same mass-to-charge ratio. The advantage of this embodiment is that it permits analysis with increased sensitivity.

Figure 6A:
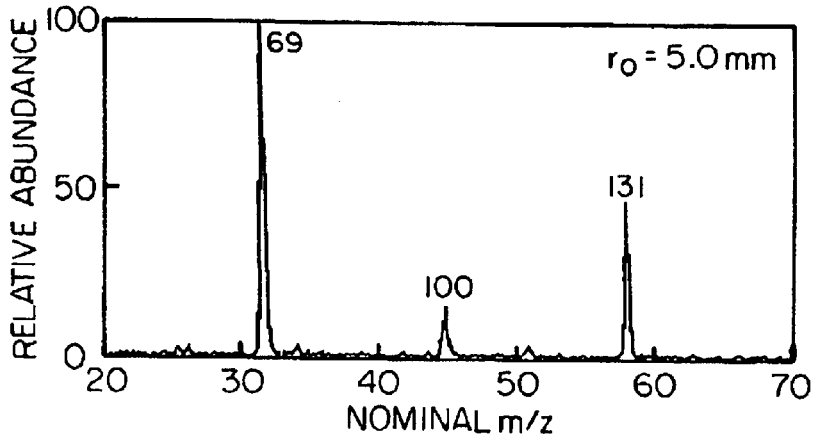
FIGS. 6A–6C show mass spectra which illustrate the effect of relative trap dimensions on the mass spectrum of a mass calibration compound.
Figure 6B:
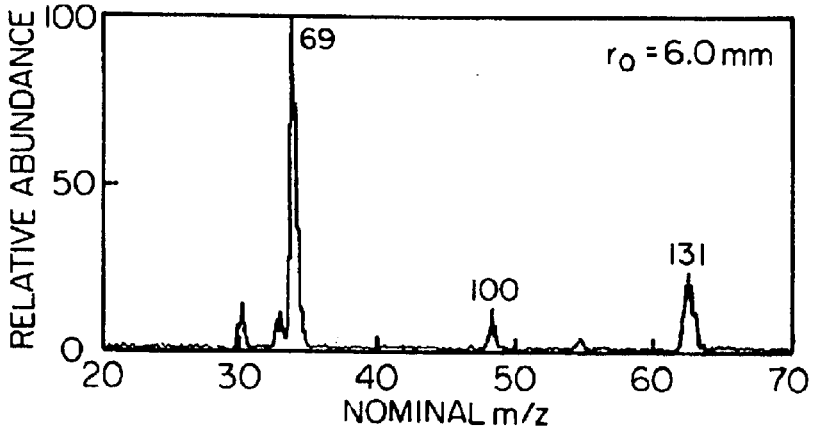
Figure 6C:
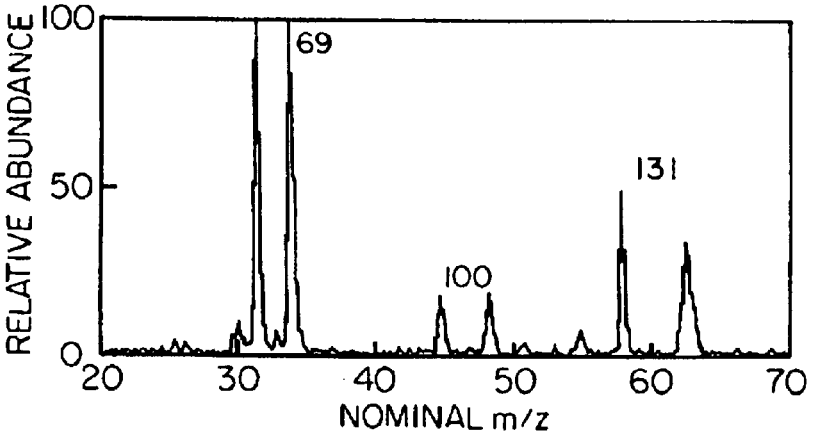

FIGS. 6A–6C show the results of an experiment that demonstrates the effect of trap dimensions on mass range using a two CIT array with a trap of 5.0 mm radius and a trap of 6.0 mm radius. In each case the length of the cylindrical electrodes was 6.80 mm. These data represent the reduction to practice of the basic concepts underlying the first embodiment. FIG. 6A shows the spectrum for a sample obtained by scanning the amplitude of the rf voltage for a trap having 5.0 mm radius. FIG. 6B shows the spectrum of the same sample obtained by scanning the amplitude of the rf voltage for a trap having 6.0 mm radius. FIG. 6C shows a spectrum recorded from both traps operated by scanning the rf simultaneously with a single electron multiplier detector. This shows how the relative size of the traps causes ions of the same mass/charge ratio to become unstable at different times, corresponding to different values of the rf amplitude. This results in a separation of the signals due to ions of a given mass/charge ratio when the two traps are operated in an array. The ions from the 5.0 mm radius trap are ejected during a mass selective instability scan before their counterparts in the 6.0 mm radius trap, as seen from the labeling of the peaks in terms of nominal mass-to-charge ratios. This demonstrates that the $r_0$ and $z_0$ parameters affect the location of the ions of different masses in the stability diagram. On the basis of these data, it can also be understood how selection of ions of single mass/charge ratios by the chosen isolation method (rf/dc, waveform or other method) will allow ions of different mass/charge ratios to be trapped in different CITs in an array. This permits mass analysis of a sample by trapping ions of different mass-to-charge ratios and then using a pulse to eject the ions into a detector associated with each trap volume.

The process of trapping ions into the array can be achieved in a number of ways. The rf voltage applied to the cylindrical electrodes is fixed to a value suitable for trapping ions having mass-to-charge ratios over a preselected range. Electrons are then injected into the trapping volume to ionize species already present as neutrals. This method might employ a single electron source or an array of electron emitters (such as a field emission array source) that allows each array element to have its own electron source. Alternatively, the ions can be externally ionized and injected into the trapping volume after appropriate ion optical manipulation of the beam cross-section and energy, either with a single point ion source or an array of external ion sources. External or internal ionization could be performed simultaneously, with all traps or elements in the array being filled at once, or sequentially.

The ion trapping capacity of the ion trap is expected to vary in a linear fashion with $r_0$. H. G. Dehmelt, Advan. Atom. Mol. Phys. 3, 53 (1967) showed that the maximum storable charge equals $4Dz_0$, where D is the pseudo-potential well depth and is proportional to V and $q_z$ while being independent of $z_0$ and of ion mass. If the flux of ions arriving at the array is uniform across the array, then the smaller traps will fill with mass-selected ions more quickly than the larger ones. This will result in ions of higher mass/charge ratio having a lower probability of being collected since the trap area that is active to them is smaller. To compensate for this, the surface areas covered by traps of various sizes may need to be appropriately adjusted, by adjusting the number of traps of each size or by decreasing the graduations in size between the smaller CITs that trap higher mass ions. The former action would mean that the array would include a number of like-sized ion traps. This procedure is used in the second embodiment of the invention to be discussed.

The arrangement of the CIT elements on the surface of the array might itself, as just noted, be used as a factor to increase analytical performance. As another example, were the elements to be randomly arranged, it would be a simple matter to use a rotating mask to implement a Hadamard experiment. In such an experiment, the signal from a randomly selected group of detectors is measured, the selection is changed and the measurement is remade, the overall result being acquisition of signal from each detector element with enhanced sensitivity. Alternatively, a regular arrangement with electronic detector element switching could be used for the same purpose. The arrangement of elements on the surface will also be one factor that determines the weighting given to different regions of the mass spectrum. It is possible to select the shape of the array surface so that a systematic increase/decrease in CIT radius occurs and the $r_0$ and $z_0$ ratio is maintained at the optimum ratio, while the spacing across the surface is also optimized.

Figure 7A:
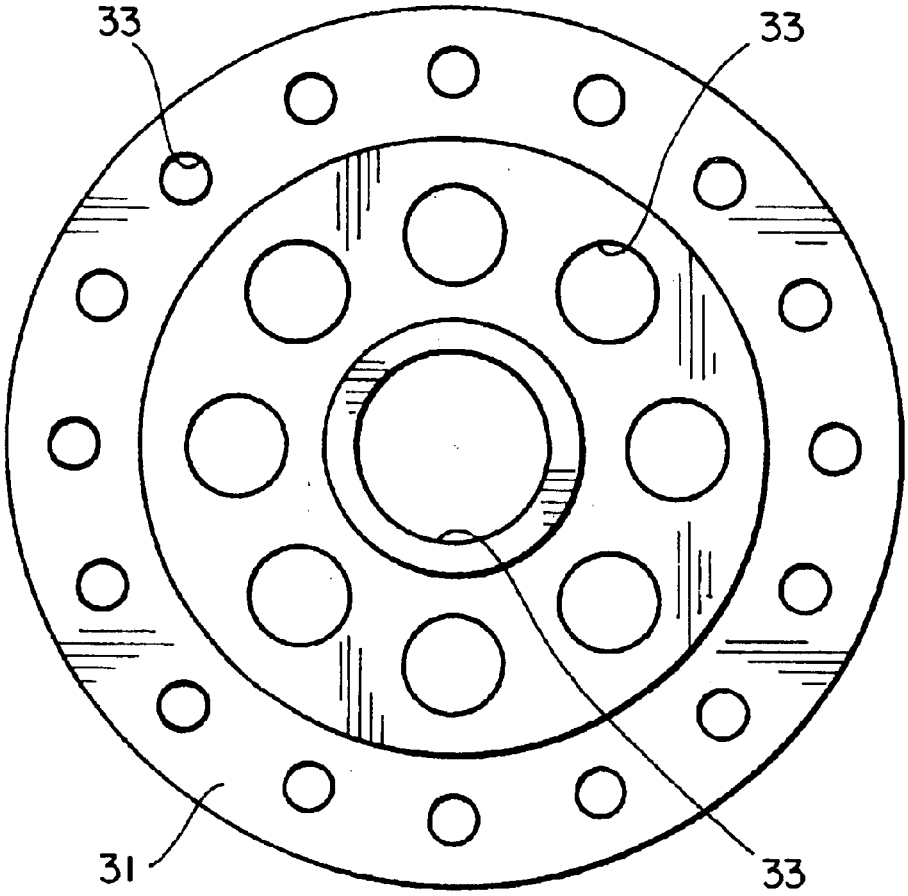
FIG. 7A is a top plan view of another ion trap having a cylindrical ring electrode array of different sizes.
Figure 7B:
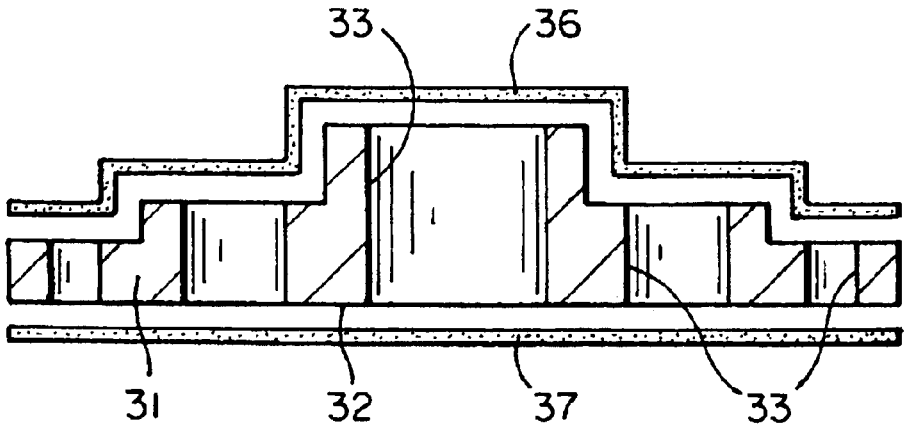
FIG. 7B is a cross-sectional view of the cylindrical ring electrode array of FIG. 7A.

One such method uses a conductive body of substantially parabolic cross-section with a flat base. The flat base facilitates read-out into one or more planar detectors. Such a design is shown in FIGS. 7A and 7B. FIG. 7A shows a top plan view of a cylindrical ring electrode array in which multiple cylindrical electrodes of the smaller dimensions are formed in body 31 to compensate for the total surface area covered by each size of trap. FIG. 7B is a sectional view of the array in FIG. 7A, showing the body 31 of decreasing radial thickness (convex) with a flat base 32. The cylindrical ring electrodes 33 decrease in size and length as one goes radially outward. Endcaps 36 and 37 are on opposite ends of the cylindrical ring electrodes 33. A concave array would place the small CITs which correspond to the trapping of high mass ions, at the center of the device where the ion optics will presumably be best. It is possible to imagine more complex CIT arrangements in which the gradual change in selected mass with position is replaced by an arrangement in which larger and smaller elements are juxtaposed. The results would be very different in terms of the types of data analyses they would allow.

The array might be operated in at least two modes. First, the rf trapping voltage and dc isolation voltage applied to the ring electrode are kept constant during the entire trapping and analysis process. This mode of operation allows for greatly simplified electronics using only a single rf voltage and dc voltage. A second method uses two rf voltage levels, while only using the dc voltage for rf/dc isolation or trapping. One rf voltage level is used in order to "fill" the CITs during the ionization process, the other rf voltage is used in the mass isolation step. This benefits from the fact that the pseudo-potential well is deeper and the trap capacity greater at high $q_z$, and the trapping efficiency is also $q_z$ dependent. Both of these features suggest that operation with two rf voltages might increase sensitivity of the array by improving trapping efficiency and increasing the total number of ions able to be trapped. Conversely, the first mode (using a single constant rf/dc level) can be operated with a longer "fill" time, thus allowing for greater ion accumulation. As stated earlier, the major advantage of the first mode is the use of a constant rf/dc level. Waveform isolation methods (e.g. SWIFT) could be used with only one rf level, since the isolation waveform can be chosen to select an ion at any $q_z$-value, and not just at the apex, as in rf/dc isolation. Also, when using waveform isolation, the rf voltage necessary remains at the low level needed for optimal trapping and need not be raised to bring ions to the apex. No dc is needed in SWIFT and related waveform isolation and ion manipulation methods. The waveform isolation method typically requires less than 10 $V_{p\text{-}p}$ for isolation.

Figure 8:
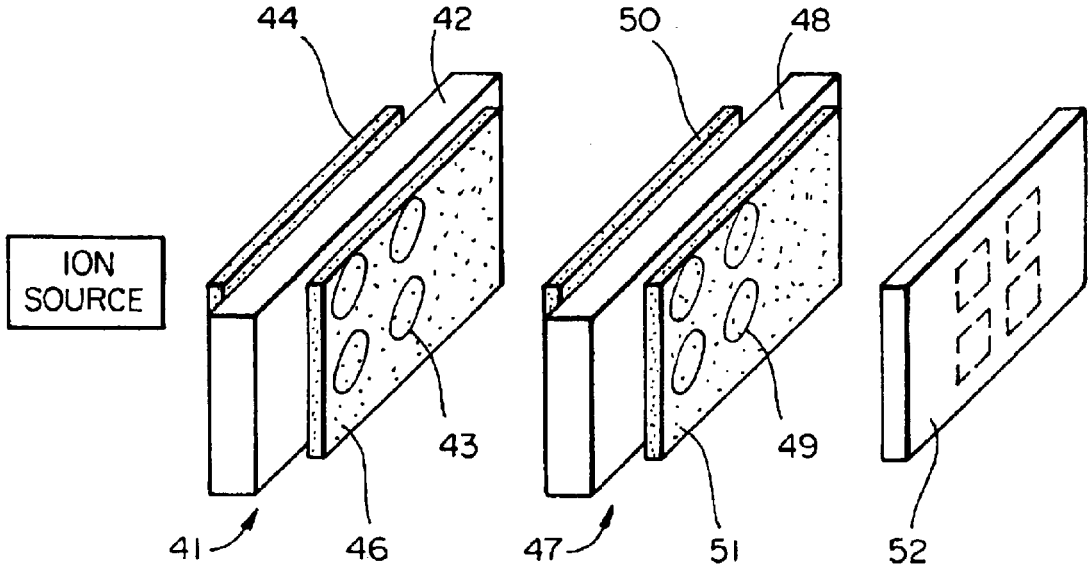
FIG. 8 is a schematic perspective view of two CIT arrays connected in series.

A more complex method that can be used to fill the array would use a second ion trap array, immediately preceding the first array. Referring to FIG. 8, a first array 41 includes a body 42 with cylindrical elements 43 and mesh-type endcaps 44 and 46 which allow injection and ejection of ions into and from the ion traps defined by the cylindrical ring elements and the endcaps 44 and 46. A second array 47 is juxtaposed to the first and includes a body 48 with cylindrical elements 49 and mesh-type endcaps 50 and 51. The first array 41, composed of ion traps of either identical or varied sizes, would be used to accumulate ions before they are transferred into the second array 47. In the first array, ion isolation using methods described previously could be used in order to increase the number of ions trapped by performing a longer "fill" time before ejecting them into the second array. Alternatively, ions could be mass-selected and injected into the second array multiple times from the first array without prior isolation. Such a serial array of ion traps could also consist of a single ion trap followed by another single ion trap The resolution of the array can be manipulated by changing the amplitude of the dc potential applied to the trap electrodes; working at the apex of the ion trap stability diagram, FIG. 3, gives (in principle) infinitely high resolution, while lowering the dc increases the range of m/z values of the ions trapped in a particular array element. Alternately, using a waveform isolation method, the resolution can be controlled by reducing or increasing the bandwidth of the waveform isolation pulse. A less flexible method of affecting the resolution is by decreasing the size gradation between traps, i.e. making $r_0$ between adjacent sized CITs smaller. The larger the number of traps of different sizes, the higher the resolution, but the smaller the fraction of the array area that is available to trap ions of any particular mass range. Hence, the "duty cycle" of the instrument decreases as the resolution increases. However, compared with conventional mass selective instability trap scans, the duty cycle in terms of the mass analysis step is highly favorable since all ions leave the traps at the same time and are detected simultaneously using a position-sensitive detector.

It is a simple step to go from an array built to cover a mass range uniformly, to a device designed to examine selectively for particular compounds. Such a device could be used to selectively interrogate for ions of a few selected mass/charge ratios or even a single mass/charge ratio, by using CIT(s) of appropriate size corresponding to the characteristic m/z values of the ion(s) of interest. The sensitivity of such a device to each of the components of interest could be optimized by selecting the appropriate number of CITs (actually, total area covered by CITs of a certain size). Since the CIT array is a rather simple structure, the components of which are potentially replaceable at small cost, the mass spectrometer could be switched between different specialized applications quite easily. These "selected ion CIT arrays" could be used with a much smaller number of detectors than envisioned for an array designed to produce a wide range mass spectrum.

Ejection of trapped ions from the individual ion traps for detection can be achieved in a number of ways. Referring to FIG. 8 by way of example, application of a short dc pulse on the endcap electrode 50 opposite the detector will eject all ions through the mesh-type endcap 51 simultaneously from all traps onto the position-sensitive detector 52. The position of the signal correlates with the mass/charge ratio of the ions. Second, ions can be ejected by stepping the rf voltage to a suitably high value (corresponding to $q_z$ values in excess of the stability boundary). Third, and least desirably, ejection might be by means of an rf voltage ramp, as is commonly done. In each case, detection can be by means of a position-sensitive array detector, or, for experiments in which the objectives are limited, by point detectors (e.g. an electron multiplier or Faraday cup). The first and second mode of ion ejection provide a simpler method than the rf voltage ramp, and therefore allow use of the invention with a smaller control electronics package.

The pressure tolerance of an array of ion traps is expected to be good, given that ion traps are already pressure tolerant compared to other mass spectrometers, and that tolerance is augmented by the small size of the device. During mass analysis, collisions are undesirable; however, the short times and relatively quick acceleration of ions to high kinetic energies, where the effects all but disappear, makes pressure effects on the mass selective instability scan small. In the mode used with the device described herein, the effect of higher operating pressures is likely to be much smaller because all ions in each trap will be ejected at once, and only the total integrated ion signal is of interest, not the shape of the signal for ions of particular individual mass/charge ratios.

The detector needed to operate the CIT array must combine sensitivity to position with high sensitivity to low ion numbers released in a short period of time (i.e. as a transiently high ion current). The combination of a microsphere plate and micro-Faraday cup array is preferred. Many other designs are possible. Requirements are that each channel must be able to record a signal as small as 30 ions, and as large as $10^5$ ions ejected in a time on the order of 10 microseconds. Signal averaging will improve dynamic range. A point detector such as an electron multiplier can be used by moving it to receive ions from selected trap elements.

Chemical identification using the CIT array will depend on the type of variable radius array used, that is, whether the mass isolation window in each array element is a single m/z value (a selected ion CIT) or whether a larger mass window is used. In the case of selected ion CIT arrays with each element of the array trapping ions of a single m/z of interest, the signal from each element will either confirm or reject the presence of ions of the m/z value of interest. This is the simplest type of signal processing involved. As the resolution of each CIT is reduced (i.e. the dc voltage is reduced, and a wider range of masses are trapped in each CIT), a signal processing method such as partial least squares, pattern recognition or artificial neural networks may be necessary to identify the analytes. The signals obtained will essentially be a histogram of the analytes' mass spectrum which must be deconvoluted in order to provide information about the presence or absence of particular compounds.

It will be apparent to one skilled in the art that non-destructive detection can be used for ion detection. In such an instance, image currents are analyzed by Fourier transform. See U.S. Pat. No. 5,625,186 issued Apr. 29, 1997, which is incorporated herein by reference.

Figure 9:
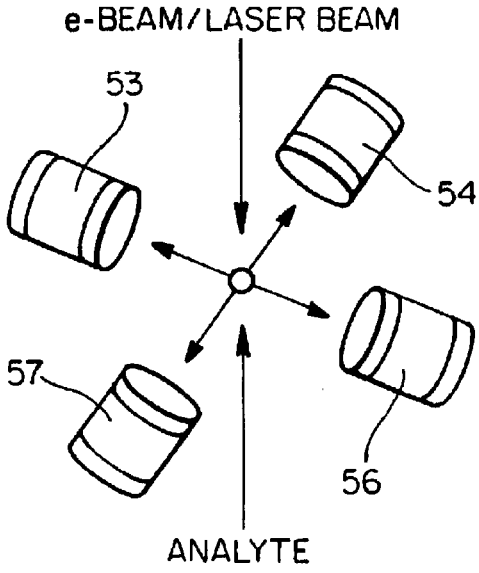
FIG. 9 shows another CIT array with the individual ion traps of different $r_0$ and $z_0$ dimensions.

FIG. 9 schematically illustrates four individual CITs, 53, 54, 56 and 57, having different $r_0/z_0$ dimensions for capturing single ions or ranges of ions of different mass-to-charge ratios with the same rf/dc voltages applied to each of the CITs. The miniature ion traps may be formed as discussed above. They are positioned to receive sample ions formed by ionization of an analyte by e-beam or laser beam ionization. The ion traps are operated as described above to perform destructive or non-destructive ion analysis.

Figure 10A:
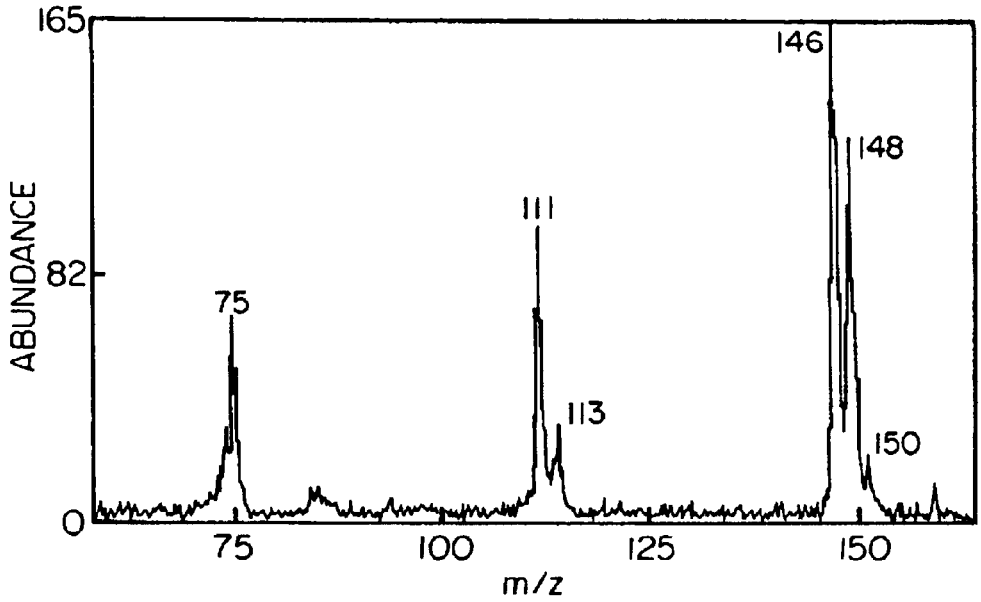
FIG. 10A is a mass spectrum showing signal intensity obtained from four identically-sized CITs in a parallel array operated with a single ion source, single source electronics and a single detector.
Figure 10B:
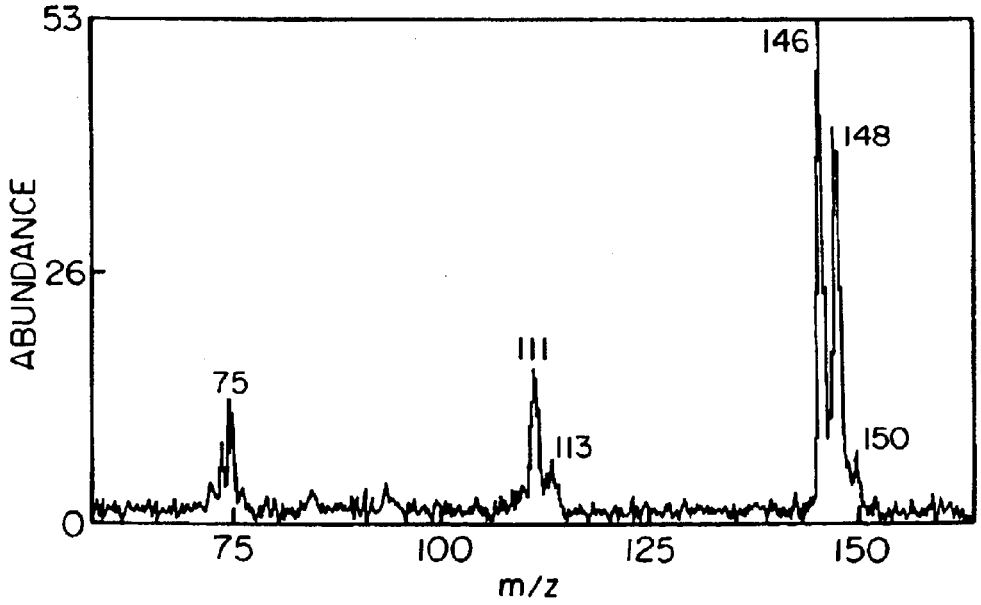
FIG. 10B is a mass spectrum showing signal intensity obtained from two of the four CITs in the parallel array described in FIG. 8A.

The second embodiment of the invention, FIG. 5, consists of a parallel array of identical-sized CITs operated under identical trapping conditions. As discussed above, parallel operation of identical-sized CITs is used to regain ion trapping capacity lost as a result of the small size of a single CIT, or to increase throughput in experiments where overfilling of the ion trap is possible or when multiple parallel analyses are to be analyzed in a high-throughput mode, such as in combinatorial library screening. FIG. 10A shows a spectrum of dichlorobenzene where four identical-sized CITs are used for mass analysis, while FIG. 10B shows a comparison under the same experimental conditions when only two of four traps are used. Both traps were operated in the normal mass-selective instability mode with applications of a supplementary ac signal to the endcaps to improve resolution and signal intensity, as is commonly done in commercial quadrupole ion traps. Evident from the data is the increase in signal obtained as more traps of the same size are operated in parallel, a simple result of increased ion trapping capacity.

The second embodiment can also be used in conjunction with the first embodiment, as described above, to improve trapping capacity for the smallest ion traps in a variable-sized array. Filling the trap array with ions can proceed in a number of ways, as described for the first embodiment. It is possible to imagine a system in which parallel analyzers supplied by different ion sources are operated using the same set of electronics. This would increase throughput over that obtainable using a single mass analyzer, and could be coupled (for example) with a microelectrospray ion source array with the ability to feed each of the different elements in the array. When used in conjunction with the first embodiment, operation would proceed as described above.

Otherwise, operation would be consistent with the standard operation of a single Paul ion trap using the ion injection, isolation, fragmentation and mass analysis steps commonly used, with all steps being applied simultaneously to all the traps arranged in parallel.

Figure 11:
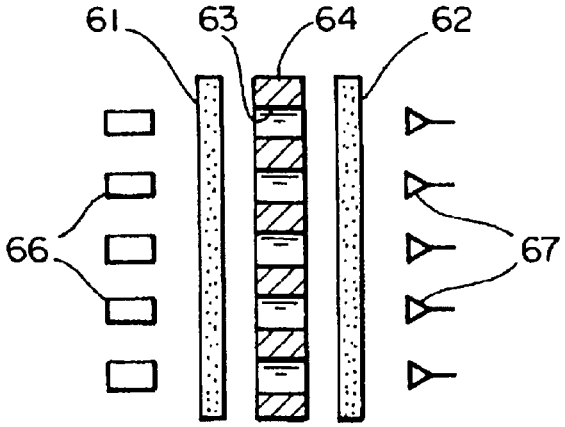
FIG. 11 shows an ion trap array in which an ion source and detector are associated with each ion trap.

FIG. 11 shows an embodiment where an ion source and a detector are associated with each CIT. The array includes mesh-type electrodes 61 and 62 with cylindrical elements 63 of the same size, formed in the body 64, as in the embodiment of FIG. 5. An ion source 66 is associated with each CIT and a detector is associated with each of the array elements. As a result, different ions can be injected and analyzed in each array element separately.

Figure 12:
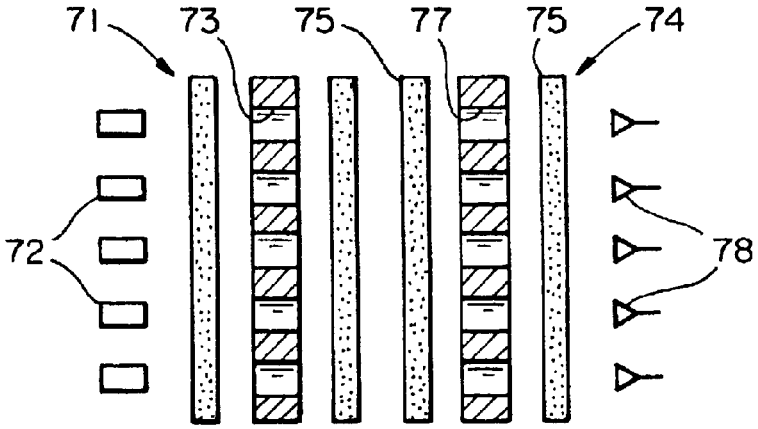
FIG. 12 shows two ion trap arrays connected in series.

FIG. 12 shows a serial CIT array. The first array 71, including mesh electrodes 70, selects and captures ions of predetermined masses from each of the sources 72 in each of the array elements 73. The trapped ions are then ejected by one of the ejection processes described above into the second array 74, including mesh electrodes 75 and array elements 77. The trapped ions are then detected 78 and analyzed. The arrays may be operated to trap ions of the same m/z ratio or of different ratios depending upon the injected ions and voltage applied to the mesh electrodes.

Figure 13:
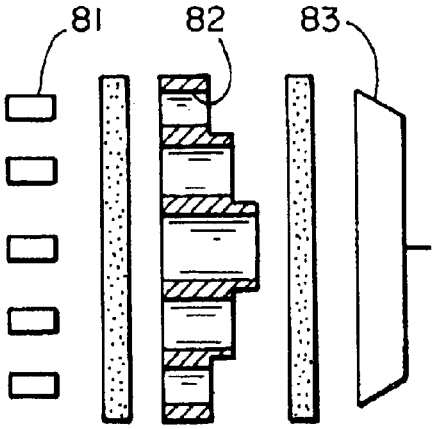
FIG. 13 shows an ion trap array having different size ion traps with multiple ion sources.

FIG. 13 shows multiple ion sources 81 injecting ions into cylindrical ring electrodes 82 of different $r_0/z_0$ to trap ions of different mass-to-charge ratios. A single detector 83 is shown although multiple detectors may be used.

There has been provided a miniature quadrupole ion trap array in which ion trap elements are operated in parallel using single trapping signals. The description of the arrays has been primarily directed to arrays in which the ring electrodes are formed in a single conductive block. However, it will be understood that the array may comprise a plurality of miniature ion traps arranged in parallel (FIGS. 4, 5, 7, 11–13) or in tandem (FIG. 8).

The foregoing descriptions of specific embodiments of the present invention have been presented for purposes of illustration and description. They are not intended to be exhaustive or to limit the invention to the precise forms disclosed, and obviously many modifications and variations are-possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

What is claimed is:

1. An ion trap mass spectrometer comprising:

a body soley of conductive material having first and second major surfaces, a plurality of parallel holes extending through said body from the first major surface to the second major surface each forming the ring electrodes of individual ion trap, a first electrode spaced from said first major surface of said body, a second electrode spaced from said second major surface of said body, said first and second electrodes forming an endcap for each of said ring electrodes to define a plurality of parallel ion traps and;

means for applying selectively rf and/or dc voltages between said end electrodes and said body to selectively trap and/or eject ions.

2. An ion trap mass spectrometer as in claim 1 in which said plurality of holes are cylindrical.

3. An ion trap mass spectrometer as in claim 1 or 2 in which the plurality of holes are of the same diameter whereby ions of the same mass-to-charge ratio are trapped and/or ejected from each of said ion traps.

4. An ion trap mass spectrometer as in claim 1 or 2 in which the plurality of holes are of different diameters whereby ions of different mass-to-charge ratio are trapped and/or ejected from each of said ion traps.

5. An ion trap mass spectrometer as in claim 1 or 2 in which the plurality of holes include holes of the same diameter and holes of different diameters whereby ions of the same and different mass-to-charge ratio are trapped and/or ejected from each of said ion traps.

6. An ion trap mass spectrometer as in claim 1 or 2 in which one surface of said body is shaped to provide areas of said body that have different thicknesses hereby the holes have different lengths and the corresponding electrode is similarly shaped.

7. An ion trap mass spectrometer as in claim 6 in which the diameter of the holes having a greater length is greater than the diameter of the holes having a shorter length.

8. An ion trap mass spectrometer comprising:

a disc-shaped body of conductive material having first and second major surfaces with at least one of said surfaces shaped such that said body has annular regions of different thickness, a plurality of holes extending through said body from the first major surface to the second major surface, each forming the ring electrode of an individual ion trap, said holes extending through the thinner annular regions having a smaller diameter than the holes extending through the thicker annular regions, a first electrode shaped to conform to the shape of the first major surface of said body, a second electrode shaped to conform to the shape of the second major surface of said body, said first and second electrodes forming an endcap for each of said ring electrodes to define therewith a plurality of parallel ion traps.

9. An ion trap mass spectrometer as in claim 8 in which the plurality of holes are cylindrical.

10. An ion trap mass spectrometer as in claim 8 or 9 in which the plurality of holes in each said different annular regions are of the same diameter.

11. An ion trap mass spectrometer comprising:

a body soley of conductive material having first and second major surfaces, a plurality of parallel holes extending through said body from the first major surface to the second major surface, each forming the ring electrode of an ion trap, a first electrode spaced from said first major surface of said body, a second electrode spaced from said second major surface of said body, said first and second electrodes forming an endcap for each of said ring electrodes to define a plurality of parallel ion traps, means for forming ions in said ion traps or for injecting ions into said ion traps, and means for selectively applying dc and/or rf voltage between said conductive body and electrodes to trap ions of predetermined mass-to-charge ratio in each of said ion traps.

12. An ion trap mass spectrometer as in claim 11 in which said plurality of holes are cylindrical.

13. An ion trap mass spectrometer as in claim 11 or 12 in which the plurality of holes are of the same diameter.

14. An ion trap mass spectrometer as in claim 11 or 12 in which the plurality of holes are of different diameters.

15. An ion trap mass spectrometer as in claim 11 or 12 in which the plurality of holes include holes of the same diameter and holes of different diameters.

16. An ion trap mass spectrometer as in claim 11 or 12 in which one surface of said body is shaped to provide areas of said body that have different thickness whereby the holes have different lengths and the corresponding electrode is similarly shaped.

17. An ion trap mass spectrometer as in claim 16 in which the diameter of the holes having a greater length is greater than the diameter of the holes having a shorter length.

18. An ion trap mass spectrometer as in claim 11 or 12 in which said means for injecting ions into said ion trap includes means associated with each ion trap.

19. An ion trap mass spectrometer as in claim 11 or 12 including means for applying ejection voltages to said endcaps to eject the trapped ions of predetermined mass-to-charge ratio.

20. An ion trap mass spectrometer as in claim 19 including detector means for receiving the ejected ions.

21. An ion trap mass spectrometer as in claim 20 in which said detector means includes a detector for each of said parallel ion traps.

22. An ion trap mass spectrometer as in claim 1, 2, 11 or 12 in which the first and second electrodes are a conductive mesh.

23. An ion trap mass spectrometer comprising a first parallel array of ion traps including:

a body of conductive material having first and second major surfaces, a plurality of parallel holes extending through said body from the first major surface to the second major surface, each forming the ring electrodes of ion traps, a first electrode spaced from said first major surface of said body, a second electrode spaced from said second major surface of said body, said first and second electrodes forming an endcap for each of said ring electrodes to define said first parallel array of ion traps, and a second parallel array of ion traps including:

a body of conductive material having first and second major surfaces, a plurality of parallel holes extending through said body from the first major surface to the second major surface, each forming the ring electrodes of individual ion traps, a first electrode spaced from said first major surface of said body, a second electrode spaced from said second major surface of said body, said first and second electrodes forming an endcap for each of said ring electrodes to define said second parallel array of ion traps, said first parallel array of ion traps positioned so that the second electrodes of said first parallel array of ion traps faces the first electrode of said second parallel array of ion traps to form a tandem mass spectrometer.

24. An ion trap mass spectrometer as in claim 23 in which said plurality of holes in each of said parallel arrays are cylindrical.

25. An ion trap mass spectrometer as in claim 23 or 24 in which the plurality of holes in each of said parallel arrays are of the same diameter.

26. An ion trap mass spectrometer as in claim 23 or 24 in which the plurality of holes in each of said parallel arrays are of different diameters.

27. An ion trap mass spectrometer as in claim 23 or 24 in which the plurality of holes in each of said parallel arrays include holes of the same diameter and holes of different diameters.

28. An ion trap mass spectrometer as in claim 23 in which means are provided for forming ions in each of said ion traps or for injecting ions into said ion traps of the first parallel array, means for applying a dc and/or rf voltage to the body of the first parallel array to trap ions of predetermined mass-to-charge ratio in each of said traps, means for ejecting ions from said first parallel array into the ion traps of said second array, and means for applying a dc and/or rf voltage to the body of said second parallel array to capture ions of predetermined mass-to-charge ratio received from the first parallel array of ion traps.

29. An ion trap mass spectrometer as in claim 4 in which the diameter of the holes is selected to trap ions of selected masses in each of the ion traps.

30. An ion trap mass spectrometer as in claim 4 in which the diameter of the holes is increased in small steps to increase the resolution of the ion trap.

31. An ion trap mass spectrometer as in claim 11 in which the trap size and the dc and/or rf voltage is selected to trap ions of a single mass-to-charge ratio to trap a specific chemical species and/or its fragment ions or the products of ion molecule reactions.

32. An ion trap mass spectrometer comprising a plurality of ion traps each including a ring electrode and end cap electrodes, means for applying the same rf/dc trapping voltages between said ring electrodes and said end caps whereby to trap ions of mass-to-charge ratio determined by the $r_0/z_0$ dimensions of each of said ion traps.

33. An ion trap mass spectrometer as in claim 32 in which the $r_0$ and $z_0$ dimensions of each of said ion traps is equal to thereby trap ions of the same mass-to-charge ratio in each of said traps.

34. An ion trap mass spectrometer as in claim 32 in which the $r_0$ and $z_0$ dimensions of selected ion traps are different to thereby trap ions of different mass-to-charge ratio in each of said ions traps having a different $r_0$ and $z_0$ dimensions.

35. An ion trap mass spectrometer as in claim 34 which includes a plurality of ion traps of the same $r_0$ and $z_0$ dimension.

36. An ion trap mass spectrometer as in claim 32, 33, 34 or 35 including means for forming ions in each of said ion traps or for injecting ions into said ion traps.

37. An ion trap mass spectrometer as in claim 32, 33, 34 or 35 including means for detecting ions trapped in each of said ion traps.

38. An ion trap mass spectrometer as in claim 32, 33, 34 or 35 in which the ions trapped in each of said ion traps are destructively detected.

39. An ion trap mass spectrometer as in claim 32, 33, 34 or 35 in which the ions trapped in each of said ion traps are non-destructively detected.

40. An ion trap mass spectrometer as in claim 32, 33, 34 or 35 in which said ion traps are operated in parallel.

41. An ion trap mass spectrometer as in claim 32, 33, 34 or 35 in which a first and second plurality of ion traps are arranged in tandem, whereby ions trapped in the first plurality of ion traps can be transferred to the second plurality of ion traps.

42. An ion trap mass spectrometer comprising a plurality of substantially cylindrical ion traps placed in parallel next to each other.

43. An ion trap mass spectrometer as in claim 42 which includes a second plurality of substantially cylindrical ion traps placed in parallel next to each other in tandem with said plurality of substantially cylindrical ion traps.

44. An ion trap mass spectrometer comprising a plurality of ion traps each including a cylindrical electrode defining a trapping region and end cap electrodes at each end of said cylindrical electrode arranged in parallel to receive sample ions and simultaneously perform a mass analysis.

45. An ion trap mass spectrometer as in claim 44 in which said end caps at each end of said cylindrical electrodes comprises a single end cap electrode for all cylindrical electrodes.

46. An ion trap mass spectrometer as in claim 44 or 45 in which the cylindrical electrodes have different dimensions to simultaneously analyze different masses.

47. An ion trap mass spectrometer as in claim 44 or 45 in which the cylindrical electrodes have the same dimensions to analyze a single mass with improved sensitivity.

48. A mass spectrometry instrument comprising:

a sample inlet;

an ion source configured to receive a sample from the sample inlet;

a quadrupole ion trap, the quadrupole ion trap comprising;

a disk shaped body consisting of conductive material having first and second major surfaces with at least one of said surfaces shaped such that said body has thinner annular regions and thicker annular regions;

a plurality of parallel holes extending through said body from the first major surface to the second major surface each forming the ring electrodes of an individual ion trap, said holes extending through the thinner annular regions having a smaller diameter then the holes extending through the thicker annular regions;

a first electrode spaced from said first major surface of said body and shaped to conform to the shape of the first major surface of said body;

a second electrode spaced from said second major surface of said body and shaped to conform to the shape of the second major surface of said body, said first and second electrodes forming an end cap for each of said ring electrodes to define a plurality of parallel ion traps;

circuitry for selectively applying dc and rf voltage between said conductive body and electrodes to trap a plurality of ions in each of said ion traps, said plurality of ions having a plurality of m/z ratios; and an ion detector configured to detect ions having a plurality of mass-to-charge rations.

49. A mass spectrometry analytical method comprising:

ionizing a sample to create at least one ion;

focusing the at least one ion into a quadrupole ion trap, the quadrupole ion trap comprising:

a disk shaped body consisting of conductive material having first and second major surfaces with at least one of said surfaces shaped such that said body comprises first annular regions and second annular regions, the first annular regions being thicker than the second annular regions;

a plurality of parallel holes extending through said body from the first major surface to the second major surface each forming the ring electrodes of an individual ion trap, said holes extending through the first annular regions having a smaller diameter than the holes extending through the second annular regions;

a first electrode spaced from said first major surface of said body and shaped to conform to the shape of the first major surface of said body; and a second electrode spaced from said second major surface of said body and shaped to conform to the shape of the second major surface of said body, said first and second electrodes forming an endcap for each of said ring electrodes to define a plurality of parallel ion traps;

applying a first predetermined rf and dc voltage between the body and endcaps respectively to trap the at least one ion;

increasing the amplitude of the rf voltage according to a predetermined rate to eject the at least one ion; and detecting the ejected ion.

* * * * *